US010644376B2

(12) United States Patent
Nita et al.

(10) Patent No.: US 10,644,376 B2
(45) Date of Patent: May 5, 2020

(54) HIGH-FREQUENCY FILTER HAVING A COAXIAL STRUCTURE

(71) Applicant: KATHREIN-WERKE KG, Rosenheim (DE)

(72) Inventors: Jens Nita, Rosenheim (DE); Martin Skiebe, Stephanskirchen (DE)

(73) Assignee: KATHREIN-WERKE KG, Rosenheim (DE)

( * ) Notice: Subject to any disclaimer, the term of this patent is extended or adjusted under 35 U.S.C. 154(b) by 862 days.

(21) Appl. No.: 15/116,697

(22) PCT Filed: Feb. 5, 2015

(86) PCT No.: PCT/EP2015/000226
§ 371 (c)(1),
(2) Date: Aug. 4, 2016

(87) PCT Pub. No.: WO2015/120964
PCT Pub. Date: Aug. 20, 2015

(65) Prior Publication Data

US 2019/0036195 A1 Jan. 31, 2019

(30) Foreign Application Priority Data

Feb. 13, 2014 (DE) ..... 10 2014 001 917

(51) Int. Cl.
*H01P 7/04* (2006.01)
*H01B 3/44* (2006.01)
*H01P 1/202* (2006.01)

(52) U.S. Cl.
CPC ..... *H01P 7/04* (2013.01); *H01B 3/441* (2013.01); *H01P 1/202* (2013.01)

(58) Field of Classification Search
CPC .... H01P 7/04; H01P 1/202; H01P 7/10; H01P 1/2084; H01B 3/441
(Continued)

(56) References Cited

U.S. PATENT DOCUMENTS 4,053,855 A 10/1977 Kivi et al.
4,268,809 A 5/1981 Makimoto et al.
(Continued)

FOREIGN PATENT DOCUMENTS

CN 201533009 U 7/2010
CN 201946731 8/2011
(Continued)

OTHER PUBLICATIONS

Machine English Translation of JP2002016411A Published on Jan. 18, 2002 (Year: 2002).*
(Continued)

*Primary Examiner* — Robert J Pascal
*Assistant Examiner* — Jorge L Salazar, Jr.
(74) *Attorney, Agent, or Firm* — Nixon & Vanderhye P.C.

(57) ABSTRACT

The invention relates to an improved high-frequency filter having at least one coaxial resonator is characterized by, among other things, the following features: the coaxial resonator comprises an outer conductor housing (1), an outer conductor (1') thus being formed; an inner conductor (3) is arranged in the outer conductor housing (1), which inner conductor is mechanically and galvanically connected to the outer conductor housing at one end of the inner conductor and ends in the direction of the outer conductor housing (1) or a housing cover (7) provided there that belongs to the outer conductor housing (1) at the opposite end of the inner conductor; the outer conductor housing (1) and the inner conductor (3) are made of electrically conductive material or are covered with an electrically conductive material; the end face (3*a*) of the inner conductor (3) and/or the additional surface (23) of the inner conductor (3) adjacent thereto is completely or partially covered with an encasing material (21), which encasing material (21) is made of a dielectric
(Continued)

material; and the dielectric material has a relative permittivity εr that is greater than 1.2.

19 Claims, 8 Drawing Sheets

(58) Field of Classification Search
USPC ..... 333/202, 203, 206, 207, 219, 222, 223, 333/224, 225, 226, 227
See application file for complete search history.

(56) References Cited

U.S. PATENT DOCUMENTS

| | | | | |
|---|---|---|---|---|
| 4,460,878 | A | 7/1984 | Fouillet et al. | |
| 6,255,917 | B1 | 7/2001 | Scott | |
| 6,894,587 | B2 | 5/2005 | Abe et al. | |
| 2006/0284708 | A1 | 12/2006 | Reeves | |
| 2007/0241843 | A1 | 10/2007 | D'Ostilio | |
| 2009/0167464 | A1 | 7/2009 | Schon | |
| 2012/0326811 | A1 * | 12/2012 | Resnati | H01P 7/10 333/234 |

FOREIGN PATENT DOCUMENTS

| | | | |
|---|---|---|---|
| EP | 1 169 747 | | 6/2002 |
| EP | 1 596 463 | | 11/2005 |
| EP | 1 721 359 | | 6/2007 |
| EP | 1 903 631 | A1 | 3/2008 |
| EP | 2 538 487 | | 12/2012 |
| JP | S58 172003 | | 10/1983 |
| JP | S58172003 | * | 10/1983 |
| JP | 2002-16411 | A | 1/2002 |
| KR | 10-2004-0058602 | | 7/2004 |
| WO | WO 2004/084340 | | 9/2004 |
| WO | WO 2009/056154 | | 5/2009 |

OTHER PUBLICATIONS

Machine English Translation of JPS58172003A Published on Oct. 8, 1983 (Year: 1983).*

English translation of the International Preliminary Report on Patentability dated Aug. 25, 2016, issued in corresponding International Application No. PCT/EP2015/000226.

International Search Report for PCT/EP2015/000226, dated May 18, 2015, 6 pages.

International Preliminary Report on Patentability, dated Jul. 8, 2016, 7 pages (German language).

English translation of Notification of the First Office Action dated Aug. 10, 2018, issued in Chinese Patent Applicatio No. 201580008320.4.

* cited by examiner

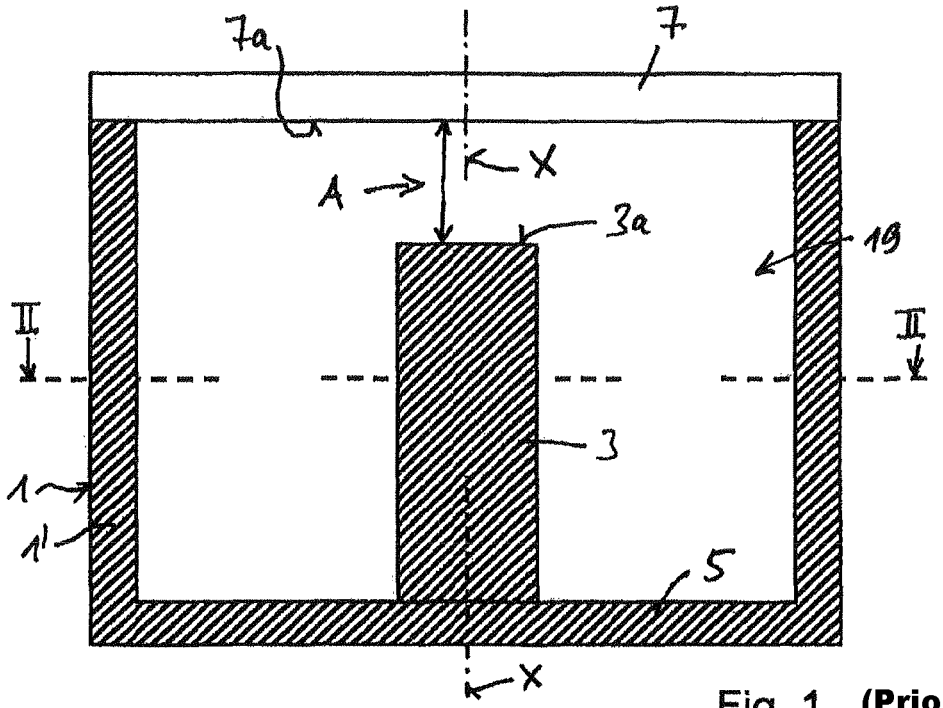
Fig. 1 (Prior Art)
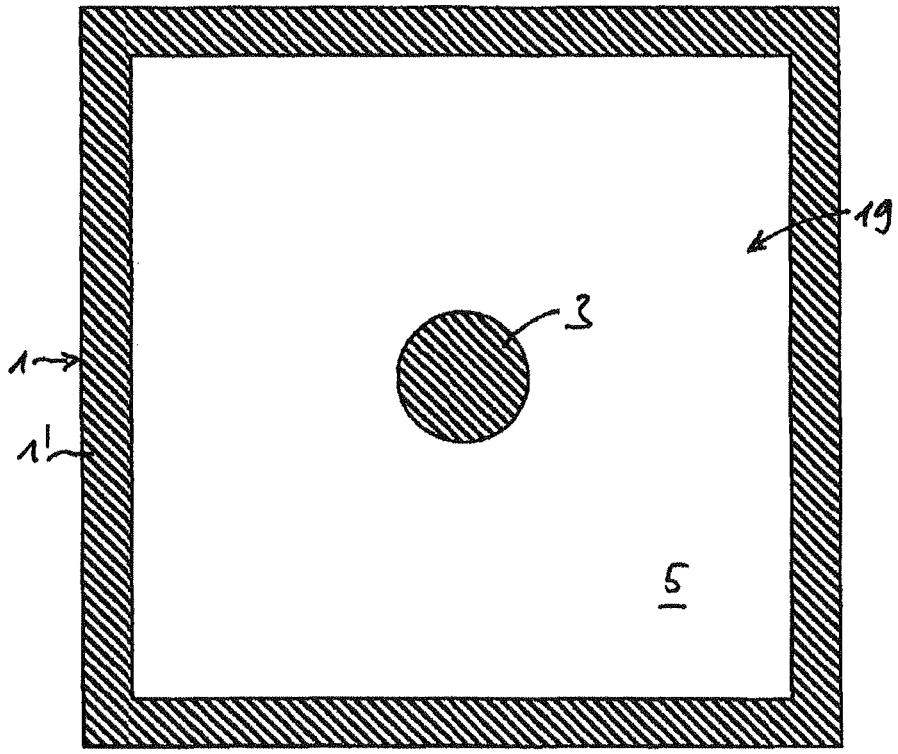
Fig 2 (Prior art)

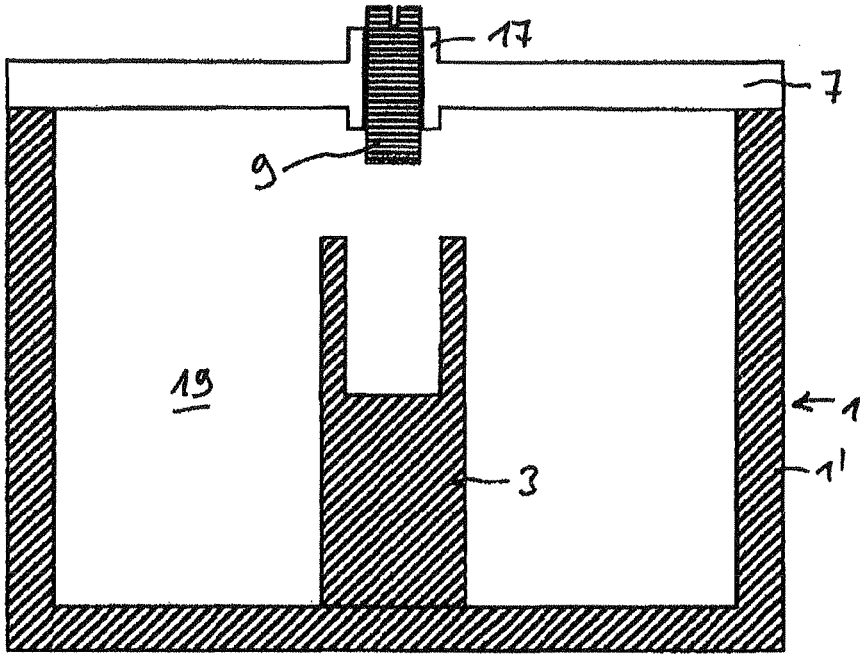
Fig. 3 (Prior Art)
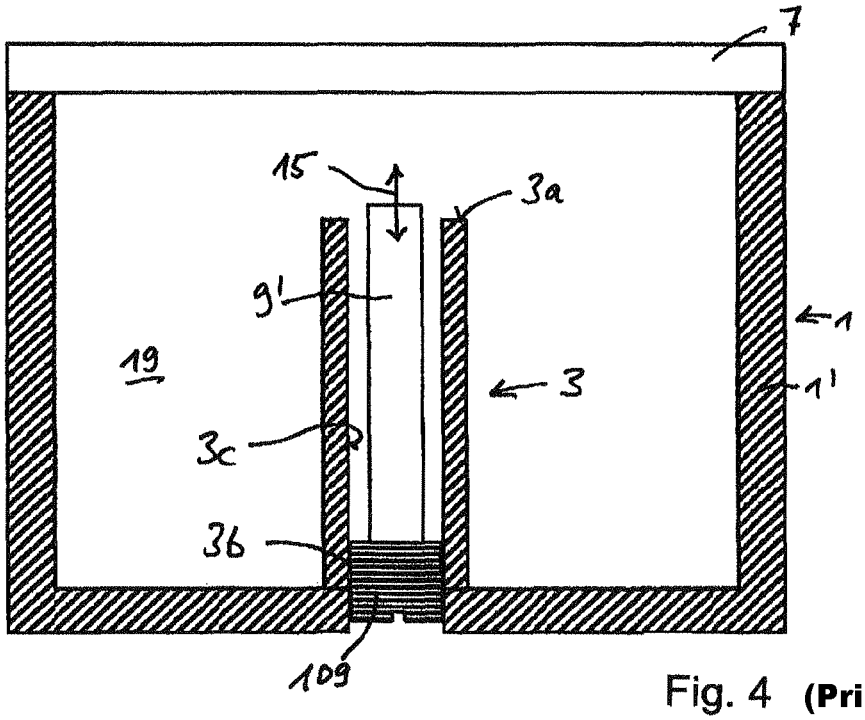
Fig. 4 (Prior Art)

HIGH-FREQUENCY FILTER HAVING A COAXIAL STRUCTURE

CROSS-REFERENCE TO RELATED APPLICATIONS

This application is the U.S. national phase of International Application No. PCT/EP2015/000226 filed 5 Feb. 2015, which designated the U.S. and claims priority to DE Patent Application No. 10 2014 001 917.9 filed 13 Feb. 2014, the entire contents of each of which are hereby incorporated by reference.

FIELD

The invention relates to a high-frequency filter having a coaxial structure, particularly designed in the manner of a high-frequency separator (such as a duplex switch) or a band pass filter or band stop filter, respectively.

BACKGROUND AND SUMMARY

Radio systems, e.g. in the mobile radio sector, often use a common antenna for transmit and receive signals. These transmit and receive signals use different frequency ranges, and the antenna must be suitable for transmitting and receiving in both frequency ranges. A suitable frequency filtering element is required to separate the transmit and receive signals, which element is used to forward transmit signals from the transmitter to the antenna and receive signals from the antenna to the receiver. Among other devices, high-frequency filters having a coaxial structure are used today to separate the transmit and receive signals.

For example, a pair of high-frequency filters can be used which both allow a specific frequency band to pass (band pass filters). Alternatively, a pair of high-frequency filters can be used which both block a specific frequency band (band stop filters). Furthermore, a pair of high-frequency filters can be used in which one filter lets frequencies under a frequency between the transmit and receive band pass and blocks frequencies above that frequency (low pass filter) and the other filter blocks frequencies below a frequency between the transmit and receive band and lets frequencies above it pass (high pass filter). Other combinations of the filter types just mentioned are conceivable. High-frequency filters are often produced in the form of coaxial TEM resonators. These resonators can be manufactured economically and at low cost from milled or cast parts and ensure high electrical quality and a relatively high temperature stability.

A single coaxial resonator produced using milling or casting techniques consists, for example, of a cylindrical inner conductor and a cylindrical outer conductor. It is likewise possible that the inner conductor and/or the outer conductor has a regular n-polygonal cross section in the transverse direction to the inner conductor. The inner and outer conductors are interconnected at one end across a large area by an electrically conductive layer (typically shorted by an electrically conductive bottom). Typically, air is used as a dielectric between the inner and outer conductors.

The mechanical length of such a resonator (with air as dielectric) corresponds to one fourth of its electric wavelength. The resonance frequency of the coaxial resonator is determined by its mechanical length. The longer the inner conductor, the greater the wavelength and the lower the resonance frequency. Electric coupling between the two resonators is the weaker the farther the inner conductors of two resonators are away from one another and the smaller the coupling aperture between the inner conductors.

A large number of proposals have been made to improve such resonators.

For example, EP 1 169 747 B1 proposes to improve frequency tuning by designing the inner conductor of the resonator as a hollow cylinder and by providing an axially adjustable tuning element consisting of a dielectric material inside the inner conductor. In contrast, EP 1 596 463 A1 proposes an adjustable tuning element in the inner conductor that is designed as a hollow cylinder made of a ceramic material, which however is coated with a sleeve-like or pot-shaped tuning body made of metal at its face end extending upwards beyond the inner conductor and across an area that dips deeply into the hollow cylindrical inner conductor. In addition, WO 2004/084340 A1 is referenced which represents and describes adjustable dielectric tuning elements in coaxial filters.

According to EP 1 721 359 B1, a coaxial resonator is to comprise a dielectric layer on the inner side of the cover in a recess provided there to increase its dielectric strength while having a small installed volume.

US 2006/0284708 once again proposes a hollow cylindrical inner conductor in a coaxial resonator with a hollow cylindrical ring placed onto its top annular end face that has the same dimensions as the hollow cylindrical inner conductor, wherein the hollow cylindrical ring consists of a ceramic material with a high dielectric constant. This ceramic ring having a high dielectric constant and low dielectric losses is inserted seamlessly between the open end of the inner conductor of the coaxial resonator and the bottom of the cover. In this way, smaller installed volumes can be attained at the same resonance frequency. In addition, the harmonic waves that can spread in the resonators shift towards higher frequencies.

According to U.S. Pat. No. 6,894,587 B2, both the outer conductor and the cylindrical inner conductor consist of a dielectric substrate. A conductive film for forming the inner conductor and for forming the outer conductor is provided on the respective outer layer of the dielectric material. The coaxial resonator is formed in this way. The dielectric material of the outer conductor comprises an axial hole in which the inner conductor applied onto the inner dielectric material is provided, forming a radial gap.

In addition, we reference U.S. Pat. No. 4,268,809, which describes a filter using multiple coaxial resonators. According to this preliminary publication, a dielectric layer is proposed that jointly covers all free face ends of the inner conductors. Opposite to the inner conductors, a conductive structure is formed on this dielectric layer that is mechanically and galvanically connected to the inner conductor using electrically conductive screws that penetrate the dielectric layer. The conductive structures formed on the dielectric layer end at a spacing from one another, which causes capacitive coupling.

Although smaller filter dimensions are frequently desired, they are either not feasible at all or difficult to achieve. In addition to the maximum permissible insertion loss, one of the factors limiting smaller footprints of the filter assemblies is their maximum rating. The rating of coaxial filters is typically determined by the distance from the free end of the inner conductor to the typically grounded cover and/or the side walls, the tuning elements, etc. A greater distance results in higher potential ratings. Specific minimum distances must be kept depending on the required minimum ratings to prevent destructive microwave breakdowns inside the filter. It is therefore not possible to reduce the size of the filter assemblies any further.

In contrast, it is the object of this invention to provide a generally improved coaxial resonator, particularly for use as a high-frequency filter, that can have a comparatively small installation size even if more complex inner conductor types are used.

As a result of the complete or partial enclosure or coating of the free ends of the inner conductor with a dielectric material whose dielectric constant is greater than 1.2, particularly greater than 2, proposed by the invention, the minimum distances between the cover, the walls and the tuning elements can be reduced even with more complex inner conductor types, since the rating is considerably increased. The enclosure can be achieved using one or more mounted molded parts. It has also proven favorable to extrusion-coat the inner conductor or the essential parts thereof fully or partially with a respective plastic material that has the desired or suitable dielectric values.

The maximum rating can be controlled via the thickness of the dielectric layer. The thicker the layer, the higher the potential ratings. Thinner layers mean smaller dielectric losses and therefore a lower insertion loss for the filter.

In principle, the maximum rating can be influenced by the selection of the dielectric material and its specific properties.

One of the major advantages of the invention therefore is that the volume of the resonator chamber, that is, the installation size of the filter assemblies, can be reduced, resulting in lower overall construction costs. At the same time, the invention permits a higher rating of the filters in a generally simple manufacturing process. Particularly the mounted or extrusion-coated inner conductors form an independent part. The full-area or partial coating or full-area or partial encasing with a respective dielectric material, at least in the area of the free end of the inner conductor, can be provided for any conceivable types of inner conductors.

It is also favorable that the inner conductors used for the resonators of the invention may consist of metal as well as of a dielectric material such as ceramic. One or several or all inner conductors of a respective high-frequency filter can be extrusion-coated. Both originally molded-on inner conductors as well as insertable inner conductors, which can be turned, screwed, pressed into the resonator bottom or otherwise mechanically fastened and galvanically connected, can be encased by casting or pouring. This also results in simple handling since the inner conductor extrusion-coated with the respective sheathing material forms an independent component.

As mentioned above, molded plastic parts can be produced separately rather than provided as molded-on layers and then mounted onto the inner conductor. Molded parts can be provided with respective holders and locking mechanisms which are designed in the shape of fingers and resting, for example, predominantly in radial direction on the inner wall of the housing or the walls and/or are attached with one or several finger-like spacers on the inner or bottom side of the cover.

The advantages according to the invention, that is, a reduction of the installation size, an increase in rating and an improvement of the dielectric strength of each of the resonators can be implemented by the following features of the invention, either alone or particularly in combination: the free ends of the inner conductors of the coaxial resonators are enclosed in a dielectric material $\varepsilon r$ greater than 1.2, particularly greater than 1.5 or greater than 2, wherein said enclosure of the ends of the inner conductors may be complete or just partial in selected areas;

- the ends of the inner conductors with the dielectric material can be enclosed by extrusion-coating or spraying, casting, or painting with suitable plastic materials and/or by mounting special molded parts made of plastic (e.g. using clips);
- the insertable inner conductors can be formed in one or multiple parts;
- the molded plastic parts can be fastened to the inner conductor or be held on the cover or side walls using molded-on supports or by the specific design of the inner conductor with undercuts into which the molded plastic parts engage;
- the inner conductors or ends of inner conductors can be enclosed if the inner conductors are insertable or integrated in. or molded to, the housing (e.g. by casting or pouring);
- the insertable inner conductors may consist of metal or a dielectric material (e.g. ceramics);
- enclosing can be performed on one, several, or all inner conductors of a respective filter; and
- all shapes of inner conductors can be enclosed, there are no limitations in that respect.

BRIEF DESCRIPTION OF THE DRAWINGS

Advantageous details of the invention can be derived from the exemplary embodiments explained below with reference to the drawings. Wherein:

FIG. 1: shows an axial section of a coaxial resonator as the basic structure of a high-frequency filter;

FIG. 2: is a cross-sectional view along the line II-II in FIG. 1;

FIG. 3: shows an axial section of a modified embodiment of the coaxial resonator of FIG. 1 with a tuning element provided in the housing cover;

FIG. 4: shows a modified embodiment of the resonator shown in FIG. 3;

DETAILED DESCRIPTION OF NON-LIMITING EMBODIMENTS

Figure 5A:
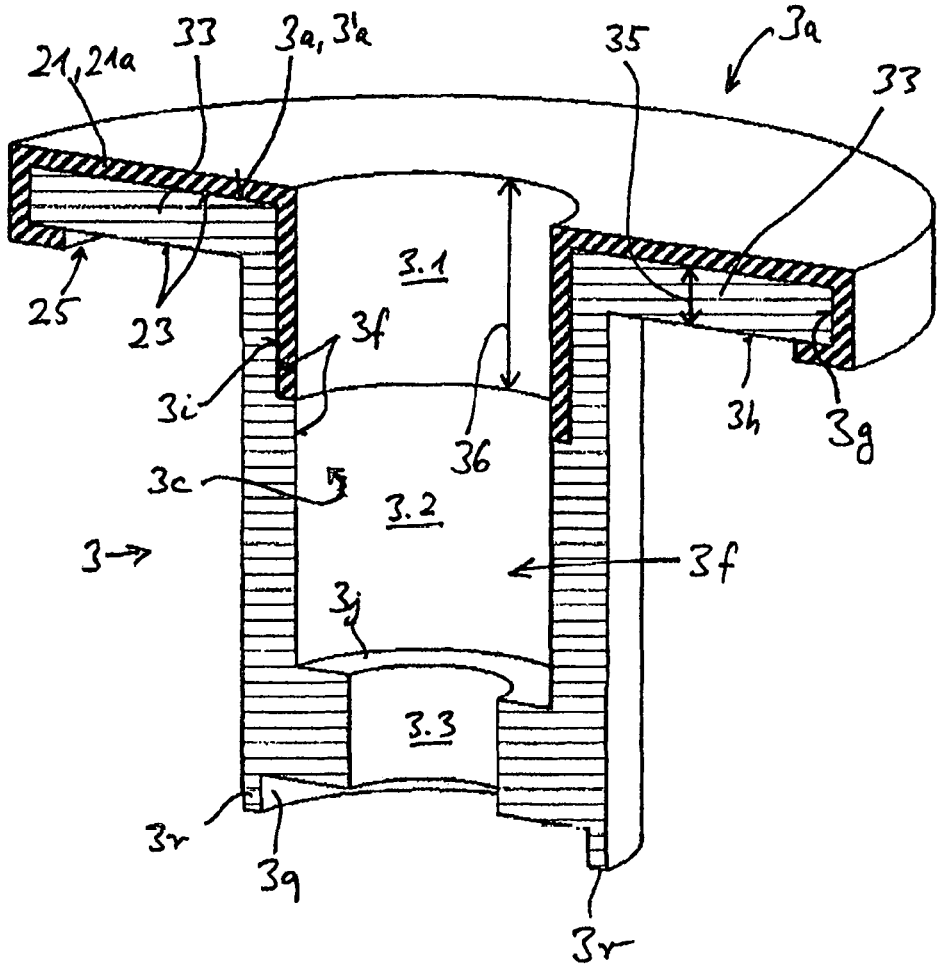
FIG. 5*a*: shows a three-dimensional representation of an axial section of an inner conductor according to the invention.

FIG. 1 shows an axial section parallel to the axial axis X, and FIG. 2 shows a horizontal section along the line II-II in FIG. 1, of a first embodiment of a coaxial resonator, here in the form of a single resonator. It is known that multiple such resonators can be combined into filter groups, for example, in the form of a band pass filter or a stop filter, etc. We make reference to known solutions in this respect.

The resonator shown, that is, the coaxial filter, includes an outer conductor housing 1 with an outer conductor 1', an inner conductor 3 arranged concentrically and coaxially with it, and a bottom or housing bottom 5 where the electrically conductive outer conductor 1 and the electrically conductive inner conductor 3 are galvanically connected.

The resonator shown in FIGS. 1 and 2 has a square cross section, wherein the outer conductor housing 1 includes a cover or housing cover 7 with which the inner resonator space 19 is closed. Like the entire outer conductor housing, the cover 7 consists of an electrically conductive material, typically a metal such as aluminum, etc. or is coated (like optionally the outer conductor 1' or housing bottom 5) at least on its inner side 7*a* with an electrically conductive layer (if the housing is made of a plastic material, for example).

The inner conductor 3 shown in the drawings can be integral with the outer conductor housing 1, that is, particularly be connected to the bottom 5, or attached and fastened there and galvanically connected to the bottom as a separate component. This can for example be achieved using respective screws which are for example screwed into a female thread in the inner conductor 3 through a hole in the housing bottom, or using a nut seated there.

In the embodiment shown, the inner conductor 3 ends as usual underneath the housing cover 7, such that there is a spacing or gap space A between the top end face 3*a* of the inner conductor 3 and the bottom or inner side 7*a* of the cover 7.

Unlike the representation in FIG. 1, FIG. 3 just shows that—as is common as well—a respective setting of the resonance frequency can be achieved by adjusting an adjusting or tuning element 9 which is pivotably housed, for example, in the housing cover 7 and can be rotated towards or away from the inner conductor 3. This adjusting element 9 is preferably seated in a threaded bushing 17 which is galvanically connected to it and penetrates the cover 7 concentrically and axially to the inner conductor 3 or through a threaded hole in the cover itself.

It is also known that said adjusting element 9 that can enter into and exit from the resonator space 19 at various lengths via the cover 7 may have a diameter and diametric shape designed for engaging in a respective axial hole 3*c* ending at the end face 3*a* in the inner conductor 3. Said adjusting elements 9 may consist of metal or a dielectric material, for example. We make reference to known solutions in this respect.

FIG. 4 schematically shows that the inner conductor can for example be designed as a hollow, that is, in the embodiment shown a hollow cylindrical inner conductor, wherein an actuating element 109 consisting of a threaded plate or threaded pot can be provided, for example, in the bottom area. This threaded plate or threaded pot comprises a male thread on its outer circumference, which is in engagement with a corresponding female thread on the inner side 3*b* of the inner conductor 3 that is provided with an inner hole 3*c*.

When the threaded plate is rotated, e.g. by inserting a suitable tool into a pivoting or drive attachment 13 which is freely accessible from its bottom side, the adjusting or tuning element 9' that is extending beyond the upper end face 3*a* of the inner conductor 3 can be set to different lengths beyond the end face 3*a* of the inner conductor 3 as indicated by the arrow 15, whereby the resonance frequency of the coaxial filter can be set.

Said inner conductor 3 can be connected in one piece, optionally integrally and thus galvanically with the housing bottom and the outer conductor walls. Such a resonator can for example be produced by milling from a metal block, however it has been noted that the inner conductor 3 can for example be connected mechanically and galvanically to the bottom later, for example by using screws.

Figure 5B:
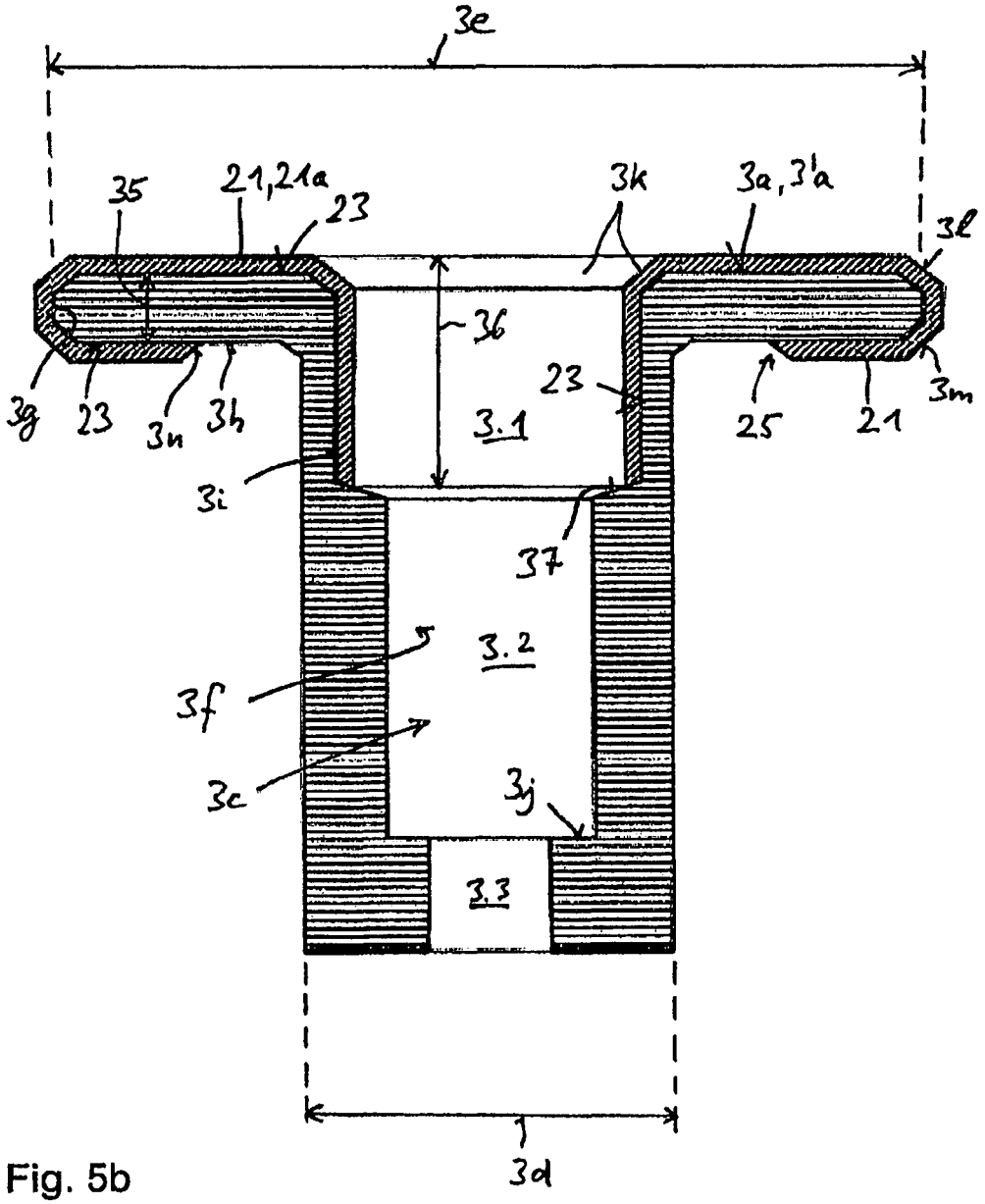
FIG. 5*b*: shows an axial section of an inner conductor slightly modified from the one shown in FIG. 5*a;*

FIG. 5*a* shows a three-dimensional axial section and FIG. 5*b* shows an axial section of a first and second embodiment, respectively, of a resonator according to the invention with a respectively adapted inner conductor according to the invention.

As can be seen from the figures, this embodiment is an inner conductor that is subsequently mechanically anchored and galvanically connected on the housing bottom—which however is not of key importance.

The embodiment shown includes that the inner conductor 3 comprises an inner conductor end face 3*a* which extends in radial direction beyond the outer diameter of the inner conductor 3, namely by forming a disk-shaped inner conductor extension area 33; however this is not strictly necessary for the invention. This inner conductor extension area 33 comprises an outer diameter 3*e* which typically is 1.01 time to 4 times the other outer diameter 3*d* of the inner conductor 3, for example 1.75 to 2.25 times that outer diameter. The thickness 35 of said inner conductor extension area 33 can also be varied selectively. It can be in the range from 0.5 mm to 6 mm, for example greater than 1 mm, 1.5 mm, 2 mm, or 2.5 mm. It can also be smaller than 5.5 mm, 5 mm, 4.5 mm, 4 mm, or 3.5 mm. Values around 3 mm are often suitable.

The end face 3*a* formed in this way with its associated end face area 3'*a* can be fully or partially coated, to a partial height, with a suitable dielectric material, starting from the end face 3*a* towards the bottom 5. In other words, a respective sheathing material 21 is provided which is provided, disposed, mounted, extrusion-coated, or sprayed on(to) the locations formed in FIG. 5*a* or in FIG. 5*b* on the surface 23 of the inner conductor 3, such that said sheathing material 21 generally sheathes the inner conductor 3 fully or partially at the locations visible in the drawings. The sheathing material 21 can either be in direct contact with the surface 23 of the inner conductor 3 at the locations shown (but also at other locations), or optionally be in indirect contact forming intermediate layers, e.g. air, between the surface 23 and the adjacent layer of the sheathing material 21.

It can be seen from the representation according to FIG. 5*a* that said sheathing material 21 in this embodiment is disposed, inter alia, on the end face 3*a* of the disk-shaped extension area 33, also on the inner wall 3*f* formed in the internal or axial hole 3*c* (which inner wall is part of the entire surface 23 of the inner conductor 3) at an axial height 36, on the outer circumference 3*g* of the disk-shaped extension area 33 and partially on the bottom side 3*h* of said extension area 33.

Said sheathing material 21 or said layered sheathing material 21 can be applied to the locations mentioned on the respective inner conductor such that a shoulder 25 is formed in accordance with the layer thickness at the locations where the sheathing ends, for example on the bottom side 3*h* of the disk-shaped extension area 33.

However, the embodiment according to FIG. 5*a* also shows that the material of the inner conductor 3 can be recessed accordingly at the locations where the sheathing material 21 is provided. A respective material recess 3*i* is for example provided in the area of the inner axial hole 3*c* of the inner conductor 3 corresponding to the inner axial height 36. The consequence is that the inner hole 3*c*, that is, the surface (inner wall) 3*f* of the inner conductor hole 3*c* can merge without a stepped shoulder from the material of the inner conductor to the sheathing material 21 at the inner axial height 36, as can be seen in FIG. 5*a*.

In contrast, FIG. 5*b* shows that the material recess 3*i* (forming a first hole section 3.1 with a larger borehole diameter) can be recessed deeper than the layer thickness of the sheathing material 21 in the section of the middle hole section 3.2 of the inner axial hole 3*c*, such that another stepped shoulder 37 is created at which the inner axial hole 3*c* merges into the hole section with the smaller inner diameter. It can also be seen in FIG. 5*b* that the middle hole section with a medium borehole diameter then merges or can merge into a bottom hole section 3.3, which has the smallest borehole diameter. On the bottom foot of the inner conductor 3, opposite the end face 3*a*, the variant shown in FIG. 5*a* shows a bottom recess 3*q* having a small axial height and a comparatively wide radial extension, such that preferably just the remaining annular shoulder 3*r* of the inner conductor 3 is mechanically connected and electrically contacted in assembled position with the bottom of the housing or an optionally provided inner conductor base.

In the exemplary embodiment shown, the inner conductor hole 3*c* is drilled forming a shoulder 3*j* at its bottom end, creating a tapering borehole diameter. This design makes it possible to anchor the inner conductor mechanically and connect it galvanically to the bottom 5 using nuts and screws.

Minor modifications were made in the embodiment according to FIG. 5*b* compared to the variant shown in FIG. 5*a*. In the embodiment shown in FIG. 5*b*, a conical bevel 3*k* is cut into the top end face 3*a* of the inner conductor 3 at the transition from the inner conductor hole 3*c*, such that the hole 3*c* becomes wider at the top, as it were.

Likewise, bevels 3*l* or 3*m*, respectively, preferably 45° bevels, are cut into the upper circumferential edge 33*a* and the bottom circumferential edge 33*b* of the inner conductor extension section 33, allowing a transition from one boundary surface to the next at the inner conductor extension area 33 at an angle of 135° each. In general, all bevels can be formed at any desired angle. Various designs of radii or curves are also conceivable instead of bevels.

Furthermore, the outgoing shoulder of the sheathing material 21 provided on the bottom side 3*h* of the disk-shaped inner conductor extension area 33 (which can also be called an extension plateau 33) has a slanted bevel 3*n*. In the exemplary embodiment shown, it is set at a 45° angle to the orientation of the extension area 33, such that the resulting opening angle $\alpha$ between opposite terminating bevels 3*n* is 90°, as shown in FIG. 5*b*.

An inner conductor 3 according to the invention that is designed in this manner can be produced by respective processing of the inner conductor material and subsequent casting or pouring a respective sheathing material 21 within the scope of the invention around it, namely on an already prefabricated resonator whose inner conductor, bottom and outer housing walls are made, for example, of a one-piece metal block. Likewise, the inner conductor can be extrusion-coated separately and subsequently connected to the bottom of the resonator, e.g. using a screwed connection. In this case, the sheathing material 21 consists of a molded-on sheathing layer 21*a*.

It is likewise possible to produce the respective sheathing material 21 separately, e.g. by casting, and mount it subsequently onto the inner conductor 3. In this case the sheathing material 21 is present in the form of a molded part 21*b*, particularly a molded plastic part 21*b*, generally a dielectric molded part 21*b*, which can be designed in one or in several parts, that is, in one piece or multiple pieces, and then mounted onto the inner conductor.

The following FIGS. 6 to 13 show schematic axial sections of a resonator comparable to FIG. 1 in which the resonator housing is indicated in cross section with an interior inner conductor.

Figure 6:
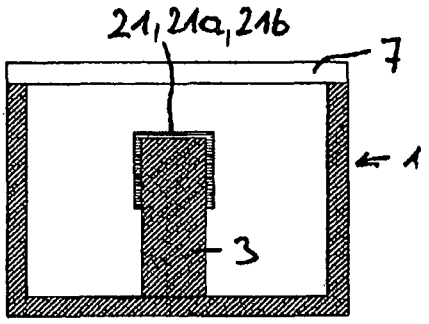
FIGS. 6 to 15: show ten different embodiments in simplified axial sectional views explaining variants with respect to the design of the inner conductor or the sheathing material provided.

The variant in FIG. 6 shows the inner conductor as a solid block. The sheathing material 21 has a pot-shaped design here and is held captively on the inner conductor 3 in the manner of an upside down pot or can from the top of the mounted molded plastic part 21*b*. The sheathing material 21 can also be a cast part 21*a* on the inner conductor 3.

Figure 7:
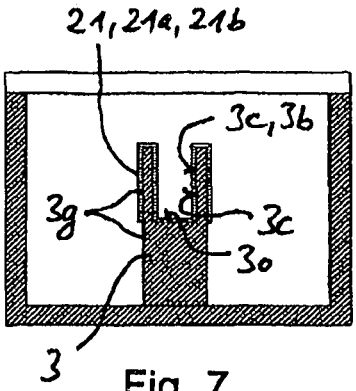
Figure 8:
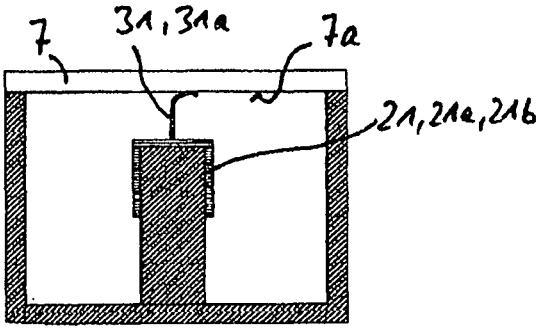
Figure 9:
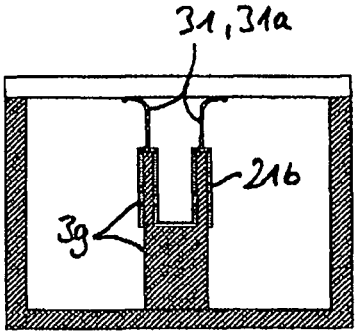
Figure 10:
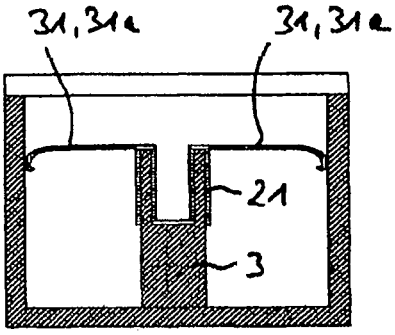

The variant shown in FIG. 9 is an embodiment in which the molded plastic part 21*b* shown in FIG. 7 can be configured with suitably molded-on supports 31 at two or more places offset in the circumferential direction (or at even more places), for example in the form of two-finger-shaped elevations 31*a* which—as explained above—are supported under bias on the bottom side of the cover 7.

In the variant shown in FIG. 10, once again two or more molded-on supports 31 offset in the circumferential direction are provided in the form of finger-shaped elevations 31*a*, which however do not extend towards the cover but rather in radial direction with at least a greater radial than axial component and which are supported, once again under slight bias, on the inner side 1*a* of the outer conductor 1.

Figure 11:
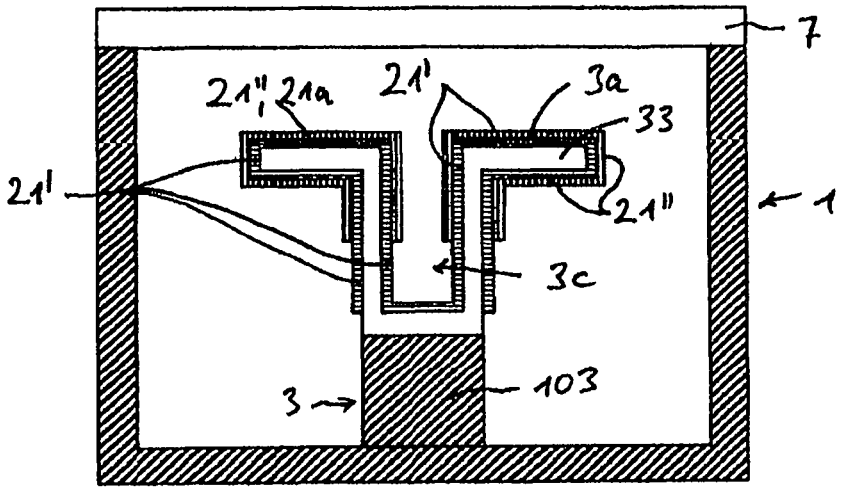
Figure 12:
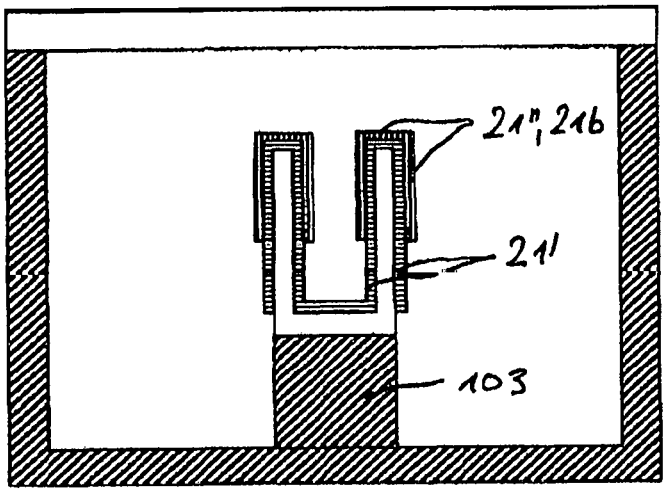
Figure 13:
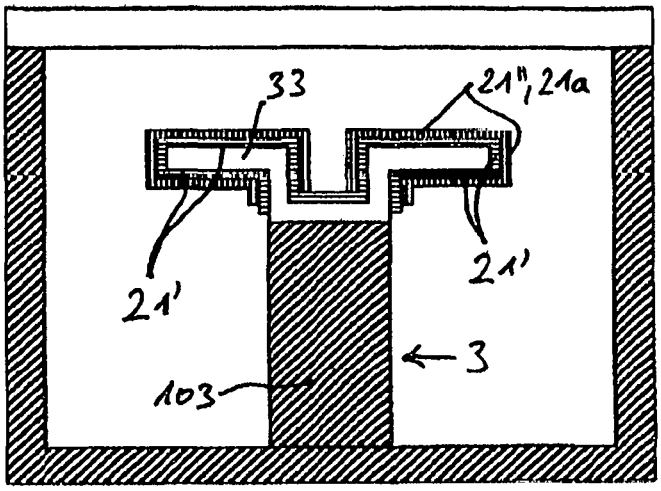

The exemplary embodiments shown in FIGS. 11 to 13 demonstrate, inter alia, that multiple molded plastic parts or different sheathing materials 21 and therefore different sheathing material layers can also be used. The exemplary embodiments shown in FIGS. 11 to 13 also demonstrate that inner conductors of the most varied designs can be used, with or without a protruding disk-shaped extension adjacent to their free end face 3*a*, with or without an inner or axial hole 3*c* drilled at different lengths into the inner conductor, etc. There are no limitations in this respect as regards the design of the inner conductor.

For example, in the variants according to FIGS. 11 to 13, the inner conductor 3 is surrounded by a layer of sheathing material 21, that is, a first sheathing material 21', according to its design both on the outside and in the area of its inner hole 3*c* and its end face 3*a*. This layer can be cast or formed as a molded plastic part and subsequently mounted onto the conductor.

A second sheathing material 21" is then cast onto this layer 21' of the sheathing material 21, e.g. at a lower partial height, starting from the top end face 3*a* in the end face area, on the circumferential edge, and at a partial height on the outer circumference and in the area of the inner hole 3*c*.

In the variant according to FIG. 12, this second sheathing material 21" can also be designed as a second molded plastic part 21*b* that is mounted from the top. FIG. 13 shows just a modified embodiment whose principles substantially match the principles of the embodiment according to FIG. 11.

Figure 14:
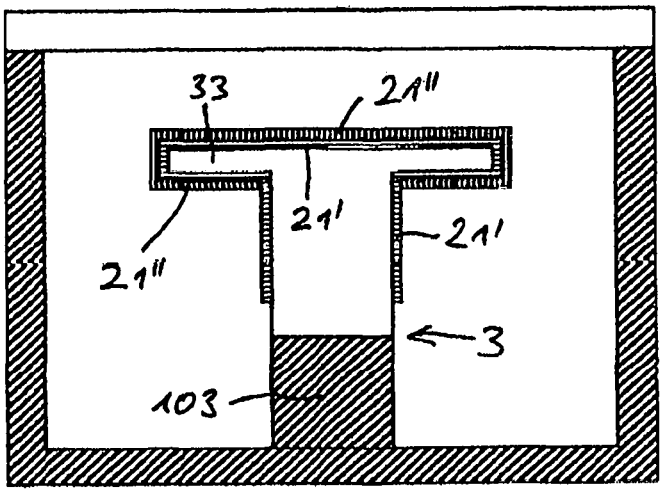
Figure 15:
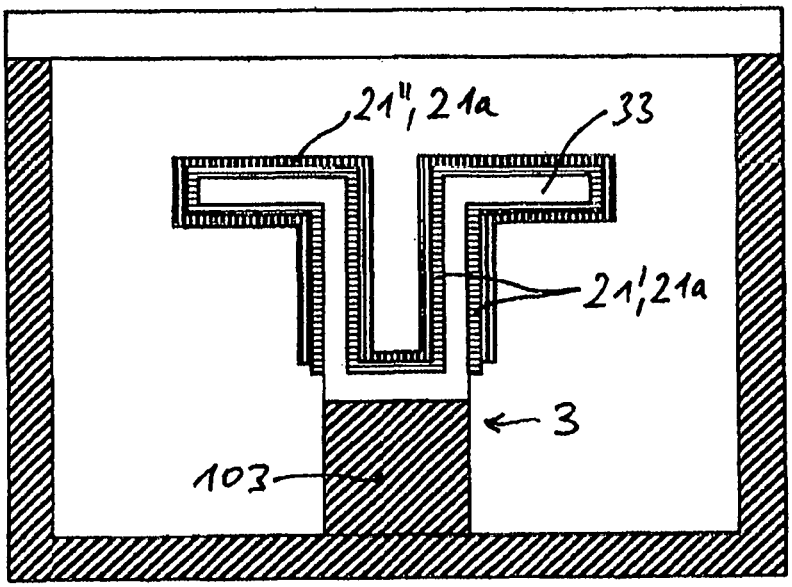

FIGS. 14 and 15 once again show that respective first and second sheathing materials 21', 21" can also be provided for an inner conductor 3 with or without an inner conductor hole 3*c*, particularly when the inner conductor is equipped at its top inner conductor end underneath the housing cover 7 with a disk-shaped plateau 33 otherwise extending radially beyond the inner conductor, i.e. the so-called inner conductor extension area 33.

FIGS. 11 to 15 further show that the inner conductor 3 depicted there is configured as a screwed-in inner conductor. This means that it is designed as shown in FIG. 5*a* or in a similar manner. Such an inner conductor 3 can be placed onto a bottom inner conductor base 103 that is fixedly connected to the bottom, i.e. the housing bottom 5 of the resonator, and mechanically anchored on the resonator housing using a screw screwed through the interior of the inner conductor, preferably for producing a galvanic connection.

It can also be seen in some of these figures that, when using a sheathing material 21 in the form of a molded part, said molded part can be mounted, for example through the extension area 33 in the manner of a snap or tilt closure depending on the design of the inner conductor, particularly when the inner conductor comprises undercuts.

Said sheathing material 21, e.g. in the form of a first and/or second sheathing material 21, has a dielectric constant εr which is greater than 1.2. Preferred values for the dielectric constant εr are greater than 1.3, particularly greater than 1.4, 1.5, 1.6, 1.7, 1.8, 1.9, 2, 2.1, 2.2, 2.3, 2.4, 2.5, 2.6, 2.7, 2.8, 2.9, and 3.0.

As explained above, said sheathing material 21, 21', 21" consists of a dielectric material. Typical and preferred dielectric materials to be considered within the scope of the invention are so-called cyclic olefin copolymers (COC).

The layer thickness of the sheathing material 21, in a multi-layer structure also with respect to the thickness of each layer, can be selected within different ranges. The thickness of the sheathing material 21 can at least be 0.05 mm, particularly more than 0.1 mm, 0.2 mm, 0.3 mm, 0.4 mm, 0.5 mm and more, while its preferred thickness is 3 mm and less.

Unlike partially crystalline polyolefins such as polyethylene and polypropylene, these cyclic olefin copolymers are materials that are amorphous and therefore transparent. Cyclic olefin copolymers are characterized by good thermoplastic fluidity, high stiffness, strength and hardness as well as low density and high transparency paired with good resistance to acids and lyes.

The filters or the coaxial resonator explained here can be used in many applications, particularly in the mobile radio sector, for example as coaxial band pass filters, coaxial band stop filters, asymmetrical band stop filters, high pass filters, duplexers, combiners, and/or low pass filters.

Typical applications are in the mobile radio sector at frequency ranges from 380 MHz to 4,000 MHz. Of particular significance in the mobile radio sector are, for example, the frequency ranges above 700 MHz, 800 MHz, 900 MHz, 1,500 MHz, 1,700 MHz, 1,800 MHz, 1,900 MHz, 2,000 MHz, 2,100 MHz, 2,500 MHz, 2,600 MHz, or above 3,500 MHz. Also of importance are narrowly defined frequency ranges under 3,500 MHz, particularly under 2,700 MHz, 2,600 MHz, 2,500 MHz, 2,200 MHz, 2,100 MHz, 2,000 MHz, 1,900 MHz, 1,800 MHz, 1,700 MHz, 1,500 MHz, 900 MHz, 800 MHz and particularly under 700 MHz, typically up to 300 MHz.

The exemplary embodiments described can be used to implement a coaxial resonator and filter or filter assemblies which achieve a higher rating and dielectric strength of each resonator and filter compared to prior art solutions by enclosing he inner conductor fully or partially, particularly in the region of its free end face and the adjacent areas with a dielectric material.

Filters with higher maximum transmitting powers can implemented in this way. At a constant required rating, enclosing the inner conductor with said dielectric material according to the invention allows smaller distances of the inner conductor to the side walls and/or the housing cover and/or the tuning elements 9, 9' provided inside the resonators.

This allows the design of filters with smaller dimensions that still have the same rating.

The invention further reduces the installation size and ultimately contributes to a reduction of the costs.

The dielectric material used or proposed within the scope of the invention permits a great tuning range or great frequency deviation.

The invention claimed is:

1. A high-frequency filter with at least one coaxial resonator comprising:

an outer conductor housing to form an outer conductor, an inner conductor disposed in the outer conductor housing, in which the inner conductor has one side mechanically and galvanically connected to the outer conductor housing and terminates on another side space apart from the outer conductor housing or a housing cover provided at, and associated with, the outer conductor housing, the outer conductor housing and the inner conductor consisting of, or coated with, an electrically conductive material, an end face of the inner conductor and an adjacent other surface of the inner conductor is fully or partially covered with a sheathing material, the sheathing material consists of a dielectric material, the dielectric material has a dielectric constant $\varepsilon_r$ that is greater than 1.2, the sheathing material consisting of, or including, the dielectric material in the form of one or several cyclic olefin copolymers (COC), a thickness of the sheathing material being at least 0.05 mm, and the thickness of the sheathing material being less than 3 mm.

2. The high-frequency filter according to claim 1, wherein the dielectric constant $\varepsilon_r$ is greater than 1.3.

3. The high-frequency filter according to claim 1, wherein the sheathing material is formed as an injection-molded part molded on and/or around the inner conductor.

4. The high-frequency filter according to claim 1, wherein the sheathing material is formed as a molded part mounted onto the inner conductor.

5. The high-frequency filter according to claim 1, wherein the sheathing material is configured in multiple parts and includes one, two, or multiple materials which is/are molded on or around the inner conductor and/or mounted thereon as a separate molded part.

6. The high-frequency filter according to claim 1, wherein the sheathing material is provided on the end face and on an outer circumference and/or at least at an axial height on an inner circumference of an inner axial hole of the inner conductor.

7. The high-frequency filter according to claim 1, wherein the inner conductor comprises on the end face an extension area that protrudes in a radial direction, in the form of a disk-shaped extension area.

8. The high-frequency filter according to claim 7, wherein the extension area has an outer diameter which corresponds to the 1.01-fold to 4-fold of the remaining outer diameter of the inner conductor.

9. The high-frequency filter according to claim 8, wherein the extension area has a slanted bevel towards its outer circumference from the outer circumference to the bottom side and/or at the transition to an inner axial hole.

10. The high-frequency filter according to claim 7, wherein the sheathing material is also provided on the bottom side of the extension area of the inner conductor.

11. The high-frequency filter according to claim 1, wherein the sheathing material is designed as a one-piece or multiple-piece molded part and mounted like a clip onto the inner conductor, which includes undercuts.

12. The high-frequency filter according to claim 1, wherein the sheathing material is equipped with at least one support which extends from the sheathing material in axial and/or radial direction and is supported, elastically, on an inner wall of the outer conductor housing and/or the housing cover.

13. The high-frequency filter according to claim 1, wherein the inner conductor and/or the sheathing material is designed in one piece and/or that less than 80% of the other surface of the inner conductor adjacent to the end face of the inner conductor is covered with the sheathing material.

14. The high-frequency filter according to claim 13, wherein the thickness of the sheathing material is more than 0.05 mm.

15. The high-frequency filter of claim 1 wherein the presence of the sheathing material increases tuning range and/or frequency deviation of the filter.

16. The high-frequency filter of claim 1 wherein the dielectric constant $\varepsilon_r$ is greater than 1.5.

17. The high-frequency filter of claim 1 wherein the dielectric constant $\varepsilon_r$ is greater than 2.

18. The high-frequency filter of claim 1 wherein the dielectric constant $\varepsilon_r$ is greater than 2.5.

19. The high-frequency filter of claim 1 wherein the dielectric constant $\varepsilon_r$ is greater than 3.

* * * * *